US007431830B2

(12) United States Patent
Cleminson et al.

(10) Patent No.: US 7,431,830 B2
(45) Date of Patent: Oct. 7, 2008

(54) COMPACT SLURRY PREPARATION SYSTEM FOR OIL SAND

(75) Inventors: Ron Cleminson, Fort McMurray (CA); David Fudge, Fort McMurray (CA); Michael Carniato, Sherwood Park (CA)

(73) Assignees: Canadian Oil Sands Limited Partnership, Calgary (CA); Canadian Oil Sands Limited, Calgary (CA); ConocoPhillips Oilsands Partnership II, Calgary (CA); Imperial Oil Resources, Calgary (CA); Mocal Energy Limited, Tokyo (JP); Nexen Inc., Calgary (CA); Murphy Oil Company Ltd., Calgary (CA); Petro-Canada Oil and Gas, Calgary (CA)

( * ) Notice: Subject to any disclaimer, the term of this patent is extended or adjusted under 35 U.S.C. 154(b) by 536 days.

(21) Appl. No.: 10/932,019

(22) Filed: Sep. 2, 2004

(65) Prior Publication Data

US 2006/0043005 A1 Mar. 2, 2006

(51) Int. Cl.

| | |
|---|---|
| ***C10G 1/04*** | (2006.01) |
| ***B01D 11/00*** | (2006.01) |
| *B65G 53/38* | (2006.01) |

(52) U.S. Cl. ..... 208/390; 196/14.52; 241/21; 241/62; 406/137

(58) Field of Classification Search ..... 241/21, 241/62; 406/137; 196/14.52; 208/309
See application file for complete search history.

(56) References Cited

U.S. PATENT DOCUMENTS

| | | | | |
|---|---|---|---|---|
| 5,772,127 | A * | 6/1998 | Maciejewski et al. | 241/21 |
| 5,954,277 | A * | 9/1999 | Maciejewski et al. | 241/21 |
| 6,027,056 | A * | 2/2000 | Maciejewski et al. | 241/62 |
| 6,821,060 | B2 * | 11/2004 | McTurk et al. | 406/137 |

FOREIGN PATENT DOCUMENTS

| | | |
|---|---|---|
| CA | 2195604 | 7/1998 |
| CA | 2332207 | 7/2002 |
| WO | WO 03/056134 | 7/2003 |

* cited by examiner

*Primary Examiner*—N. Bhat
(74) *Attorney, Agent, or Firm*—Millen, White, Zelano, Branigan, P.C.

(57) ABSTRACT

Staged crushing combined with water addition and mixing is practiced at the mine site to prepare an oil sand slurry ready for hydrotransport. More particularly, as-mined oil sand is crushed to conveyable size (e.g. —24") using a mobile crusher. The pre-crushed ore product is conveyed to a dry ore surge bin. Ore is withdrawn from the bin and elevated to the upper end of a slurry preparation tower having downwardly aligned process components to enable gravity feed. The ore is further crushed in stages to pumpable size (e.g. —4") by a stack of crushers and water is added during comminution. The ore and water are mixed in a mixing box and delivered to a pump box. The surge bin and tower are relocatable. Screening and oversize reject treatment have been eliminated to achieve compactness and enable relocatability.

10 Claims, 2 Drawing Sheets

COMPACT SLURRY PREPARATION SYSTEM FOR OIL SAND

FIELD OF THE INVENTION

The present invention relates to a system for forming an aqueous slurry of oil sand, so that the slurry is suitable for hydrotransport. The system has process and apparatus aspects.

BACKGROUND OF THE INVENTION

Over the past 30 years, as-mined oil sand containing bitumen has been slurried and conditioned at applicants' facilities in two different ways.

In the earlier process, the excavated or 'as-mined' oil sand was comminute to conveyable size (e.g. −24 inches) with a roll crusher at the mine site and transported on belt conveyors to a central bitumen extraction plant. Here the pre-crushed oil sand was fed into the front end of a horizontal rotating tumbler. Hot water (e.g. 95° C.) was also added, together with a small amount of caustic. The resulting slurry was cascaded as it advanced through the large tumbler over a period of several minutes. Steam was sparged into the slurry to ensure that it was at a temperature of about 80° C. when it exited the tumbler. During this passage through the tumbler, the slurry was 'conditioned'. That is, lumps were ablated, bitumen flecks were dispersed into the water phase, the flecks coalesced into small droplets and bitumen droplets contacted and adhered to entrained air bubbles. The emerging conditioned slurry was screened to remove oversize and was then 'flooded' or diluted with additional hot water. The resulting diluted slurry was introduced into a gravity separation vessel (referred to as a 'PSV'). The PSV was a large, cylindrical, open-topped vessel having a conical bottom. During retention in the PSV, buoyant aerated bitumen rose to form a top layer of froth, which was removed. The sand settled, was concentrated in the conical base and was separately removed.

If the oil sand was of acceptable quality (for example if it contained >10% by weight bitumen) and if conditioning was properly carried out, recovery of bitumen in the PSV was in the order of 95% by weight.

Over time, the mine faces moved further from the central extraction plant. New mines were also opened that were distant (for example, 25 kilometers away). In addition the belt conveyors were expensive and difficult to operate.

Through research and testing, it was found that if the oil sand was slurried and pumped through a pipeline for a minimum retention time, it would be conditioned as it traveled therethrough and could be fed directly into a PSV with acceptable resulting bitumen recovery.

This led to the implementation of the second system, which is commonly referred to as the 'hydrotransport system'. One embodiment, referred to as the 'Aurora' facility involves:

- Transporting the as-mined oil sand using large trucks to a primary crushing facility on the mine site, where the as-mined ore is dumped into a hopper;
- The as-mined oil sand is removed from the hopper by a bottom apron feeder, fed into a primary roll crusher and comminuted to conveyable size. The 'pre-crushed' oil sand then drops onto a collecting belt conveyor that transfers the ore to a surge bin where an active storage capacity of up to 6000 tonnes can be retained;
- An apron feeder transfers the pre-crushed oil sand from the bottom outlet of the surge bin to a belt conveyor which delivers it to the top end of a 'slurry preparation tower';

- The slurry preparation tower comprises a vertically stacked series of components, aligned to provide a gravity assisted feed through the stack. More particularly the tower comprises, from the top down, a mixing box, vibrating screens and a primary pump box. Water is added to the dry pre-crushed oil sand being fed from the lift belt conveyor to the mixing box. The oil sand and water mix and form a slurry as they proceed downwardly through the overlapping, downwardly inclined, zig-zag arrangement of shelves of the mixing box. The resulting slurry is wet screened to remove oversize, while the remaining slurry passes through the screen and into the pump box. The rejected oversize is comminuted in an impact crusher, water is added and the mixture is fed to a secondary mixing box. The slurry formed in the secondary mixing box is screened by passage through secondary screens to remove residual oversize and the undersize slurry is delivered into a secondary pump box. The oversize reject is hauled away by trucks to a discard area. The slurry in the secondary pump box is pumped back to the primary pump box; and
- The slurry in the primary pump box is then transported from the mine site to the central bitumen extraction plant through a pump and pipeline system, wherein conditioning takes place.

There are some problems associated with the Aurora facility. For example:

- The throughput of oil sand is about 8000 tonnes/hour. The facility in its present form is massive. It has a length of 270 meters. The approximate weights of the surge bin, lift conveyor and tower are 2500 tonnes, 750 tonnes and 3100 tonnes respectively. The components do not lend themselves to being relocatable. As the mine faces move away from the slurry preparation tower, the truck haulage distance increases, requiring more trucks. As a consequence, the haulage cost escalates;
- Since the slurry preparation system is tied into a pipeline equipped with slurry pumps, there is a need to limit the size of slurry particles to a maximum of about 8 inches. Otherwise stated, the solids in the slurry need to be sized so as to be pumpable. The Aurora design therefore incorporates wet screening for the purpose of removing oversize. However, this leads to the production of oversize rejects and the need for equipment to treat the rejects for recycling;
- These oversize rejects can amount to 3% of the original oil sand. There is a bitumen loss associated with the final rejects and it is expensive to haul them to a disposal area; and
- The dry ore surge bin is four sided, with twin bottom outlets feeding the apron feeder. A frequently encountered problem at Aurora is that tacky bitumen-rich oil sand has a tendency to plug the bin outlets and it is then necessary to apply air permeation to assist flow.

SUMMARY OF THE INVENTION

In accordance with the present invention, screening and reject treatment are eliminated from slurry preparation as a result of using a plurality of size reduction stages, combined with process water addition and mixing, to convert all of the as-mined oil sand supplied into a slurry of a pumpable size.

In one apparatus embodiment of the invention, there is provided an assembly of components for producing a pumpable oil sand slurry at a mine site, for transmission through a pump and pipeline system, comprising:

a primary stage of size reduction comprising first means, such as a roll crusher, for comminuting as-mined oil sand to conveyable size (for example, to −24 inches);

second means, such as a belt conveyor, for delivering the oil sand, produced by the first stage of comminution, into a dry ore surge bin;

the surge bin being adapted to receive and temporarily retain the comminuted oil sand to provide a quantum (for example, 4000 tonnes) of surge capacity;

sixth means, for example a pair of parallel apron feeders, for removing oil sand from the surge bin and transporting it to the upper end of a slurry preparation tower; and the slurry preparation tower having a downwardly descending sequence of components for forming a pumpable slurry without screening it, said tower comprising: (i) a secondary stage of comminution, preferably comprising third means, such as a stack of roll crushers, for further comminuting the oil sand from the surge bin in a plurality of downwardly descending stages, to reduce its particle size to pumpable size (for example, to −4 inches); (ii) a fourth means for adding heated water to the oil sand in the course of the secondary stage of comminution; (iii) a fifth means, for example a mixing box, for mixing the oil sand and water to produce pumpable slurry; and (iv) a pump box for receiving the slurry and feeding it to a pump and pipeline system.

In another embodiment there is provided a process for producing a pumpable oil sand slurry at a mine site for transmission through a pump and pipeline system, comprising:

comminuting as-mined oil sand to conveyable size;

delivering the comminuted oil sand to a surge bin;

removing oil sand from the surge bin and delivering it to an elevated point;

preparing a pumpable slurry using the oil sand by: feeding the oil sand into and comminuting it in a plurality of downwardly descending secondary comminution stages to sequentially reduce its particle size to pumpable size, adding heated water to the oil sand, preferably in the course of secondary comminution, and mixing them to form the pumpable slurry;

preferably aiding the slurrification process by drawing slurry from the pump box and recycling it back to the process at a point after the final comminution stage;

discharging the slurry into a pump box for feeding to the pump and pipeline system.

DESCRIPTION OF THE PREFERRED EMBODIMENT

The present invention is concerned with processing as-mined oil sand at the mine site to convert it to a pumpable slurry which is capable of being hydrotransported through a pump and pipeline system.

This is preferably done using an assembly of components which are compact and relocatable, so that the assembly can follow the advancing mine face. The components may be mobile, for example by being mounted on driven tracks, or they may be adapted for easy disassembly for periodic moving and reassembly. The term 'relocatable' is intended to describe both versions.

Figure 1:
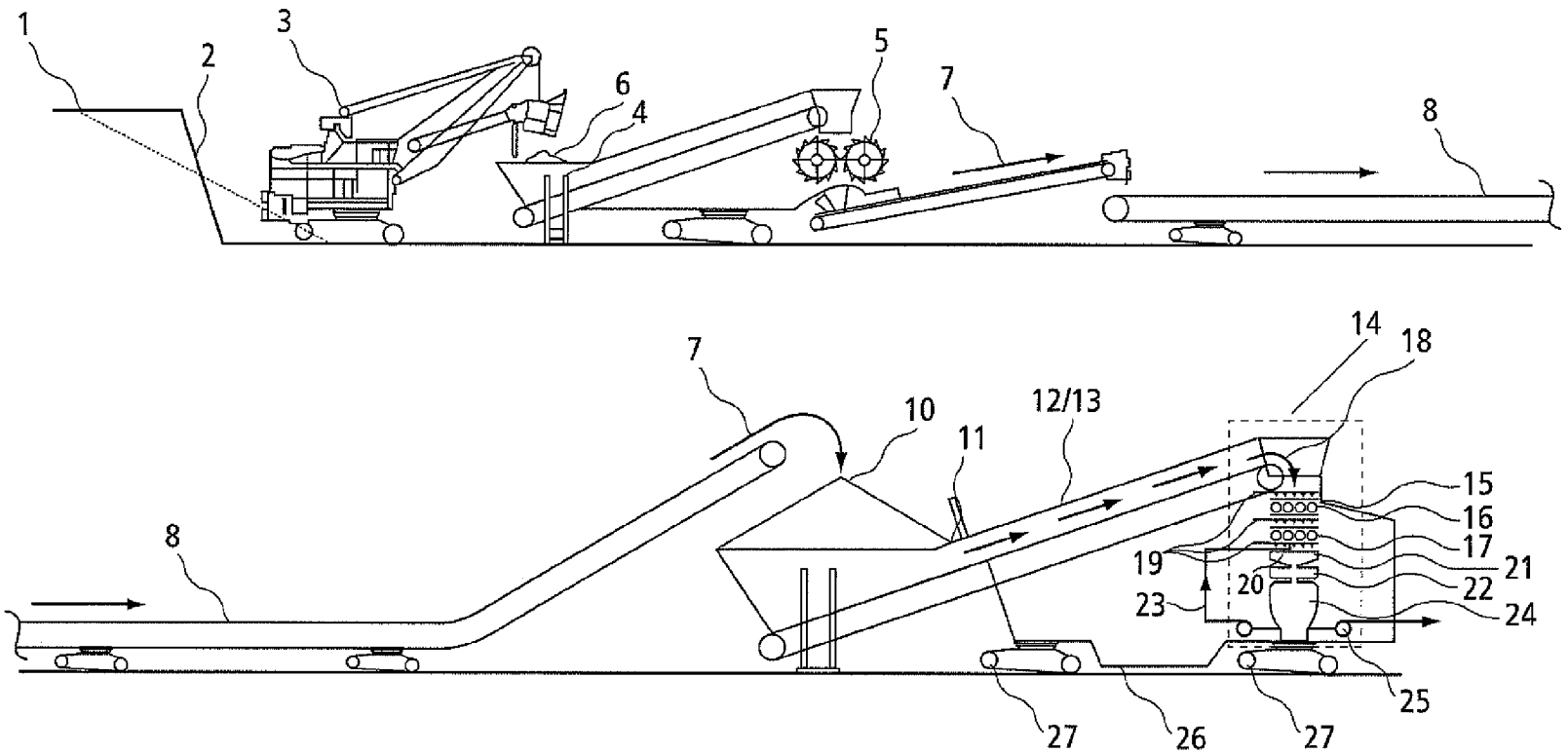
FIG. 1 is a schematic showing one embodiment of a slurry preparation system in accordance with the present invention.
Figure 2:
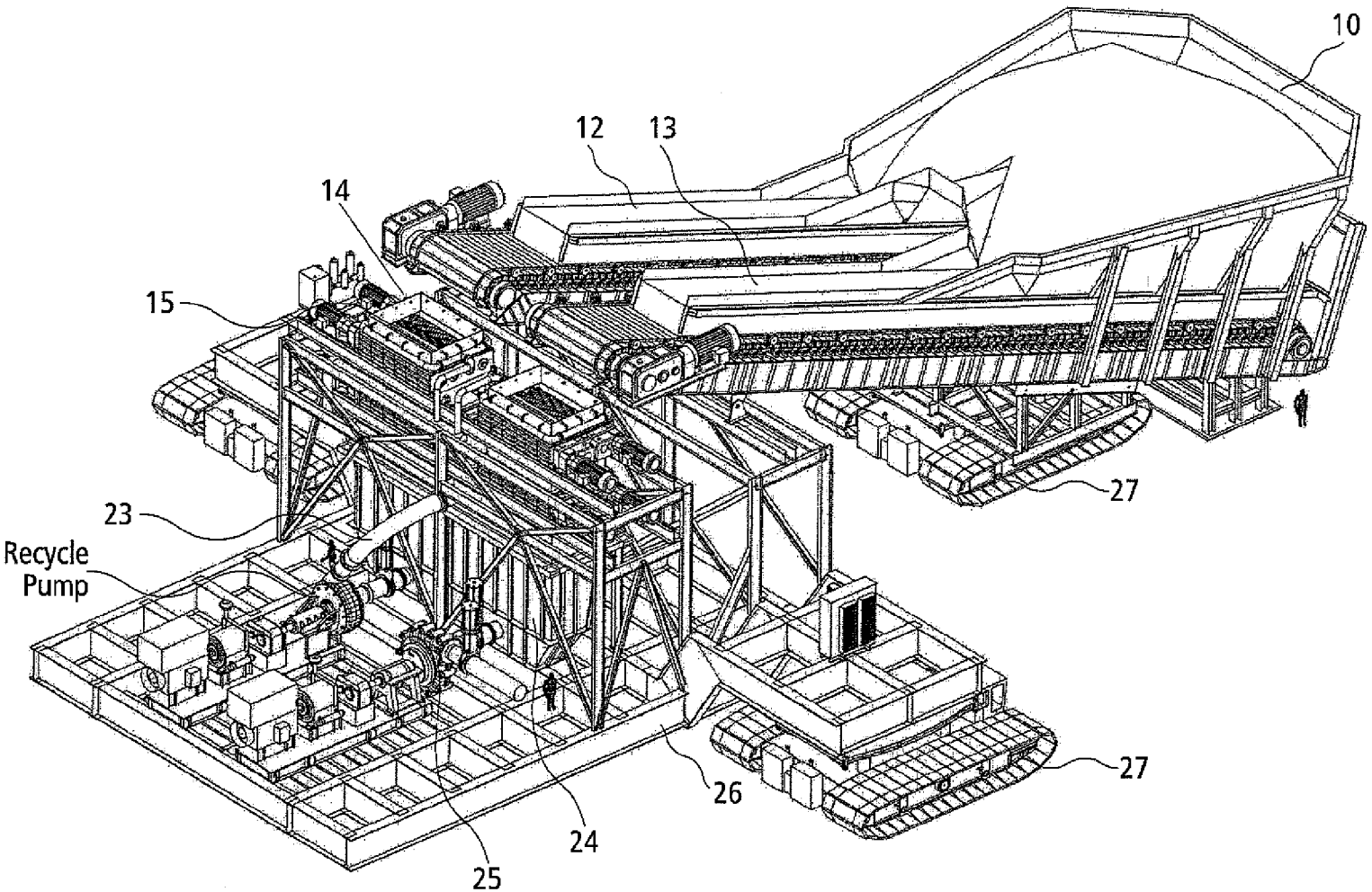
FIG. 2 is a perspective view of the dry surge bin, apron feeders and slurry preparation tower.

Turning now to the specific embodiment shown in FIG. 1 the oil sand 1 is excavated at a mine face 2 using a mobile shovel 3. The shovel 3 dumps the as-mined material into the hopper 4 of a mobile primary roll crusher 5. The primary roll crusher 5 comminutes the as-mined oil sand 6 to conveyable size (e.g. −24 inches). This comminuted oil sand 7 is referred to below as 'pre-crushed' oil sand.

The pre-crushed oil sand 7 is transported by a belt conveyor assembly 8 and is delivered into a dry ore surge bin 10.

The rectangular surge bin 10 is three sided, having an open side 11. A pair of parallel apron feeders 12, 13 extend into the base of the surge bin 10 for removing pre-crushed oil sand 7 at a slow, controlled, sustained mass flow rate. The apron feeders 12, 13 are upwardly inclined and transport and feed the pre-crushed oil sand 7 to the upper end of a slurry preparation tower 14.

The slurry preparation tower 14 comprises an arrangement of downwardly sequenced components, which rely on gravity feed.

More particularly, the tower 14 provides a stack 15 of two secondary roll crushers 16, 17, which sequentially comminute the pre-crushed oil sand 7 to attain pumpable size. Since the maximum present day pumpable slurry particle size is about 8 inches, the stack 15 of secondary roll crushers is designed to reduce the particle size, preferably to about −4 inches. This allows for some wear of the crusher rolls before requiring repair or replacement. Preferably the uppermost roll crusher 16 is selected to reduce the particle size to about −8 inches and the lowermost roll crusher 17 completes the size reduction to about −4 inches.

Heated water is added to the oil sand 7 in the course of size reduction. This is accomplished by spraying the stream of oil sand 18 being secondarily crushed with a plurality of nozzle manifolds 19 located above, between and below the crushers 16, 17, as shown. Sufficient water is added to preferably achieve a mixture 20 content of about 1.5 specific gravity.

The mixture 20 of comminuted oil sand and water drops into and moves downwardly through a mixing box 21. The mixing box 21 comprises a plurality of overlapping, downwardly inclined, descending shelves 22. The oil sand and water mix turbulently as they move through the box 21 and form a pumpable slurry 23.

The slurry 23 drops into and is temporarily retained in a pump box 24. The pump box 24 is connected with a pump and pipeline system 25. The pump box 24 feeds the system 25, which in turn transports the slurry 23 to the next stage of treatment (not shown).

As shown, the surge bin 10, apron feeders 12, 13, and slurry preparation tower 14 (including the secondary roll crushers 16, 17, water nozzle manifolds 19, mixing box 21 and pump box 24) are mounted on a common structural frame 26. The frame 26 is preferably mounted on tracks 27, so that the entire assembly may periodically be advanced to a new location.

The combination of the preferred embodiment described is characterized by the following advantages:

screening and the production of oversize rejects are eliminated;

treatment and recycling of screened oversize is eliminated;

by eliminating the screens and reject treatment units and preferably combining water addition and comminution, a relatively compact structure is achieved; and the preferred use of an open-sided surge bin, coupled with a pair of apron feeders, provides an assembly designed to promote steady oil sand removal from the surge bin.

The embodiment of the invention in which an exclusive property or privilege is claimed are defined as follows:

1. An assembly of components for producing a pumpable oil sand slurry at a mine site, for transmission through a pump and pipeline system, comprising:

(a) first means for comminuting as-mined oil sand to conveyable size;

(b) a surge bin for receiving and temporarily retaining the comminuted oil sand to provide a quantum of surge capacity;

(c) second means for delivering the comminuted oil sand into the surge bin;

(d) a sluffy preparation tower, having a downwardly descending sequence of components for forming a pumpable sluffy without screening it, comprising:

third means for further comminuting the oil sand from the surge bin in a plurality of downwardly descending stages, to reduce its particle size to pumpable size, fourth means for adding heated water to the oil sand in the course of comminution by the third means;

fifth means for mixing the oil sand and water to produce pumpable slurry, and a pump box for receiving the pumpable slurry and feeding it to the pump and pipeline system; and (e) sixth means for removing oil sand from the surge bin and transporting it to the upper end of the tower for feeding into the third means.

2. The assembly as set forth in claim 1 wherein:

the third means comprises a stack of roll crushers.

3. The assembly as set forth in claim 1 wherein:

the surge bin has one open side and the sixth means extends into the base of the surge bin through the open side.

4. The assembly as set forth in claim 1 wherein:

the sixth means comprises an apron feeder.

5. The assembly as set forth in claim 1 wherein:

the sixth means comprises a pair of parallel apron feeders.

6. The assembly as set forth in claim 1 wherein:

the first means is a roll crusher and the second means is a belt conveyor.

7. The assembly as set forth in claim 1 wherein the fifth means is a mixing box.

8. The assembly as set forth in claim 1 wherein each of components (a) to (e) is relocatable.

9. The assembly as set forth in claim 1 wherein each of components (b), (d) and (e) are mounted on a single common base frame.

10. A process for producing a pumpable oil sand slurry at a mine site for transmission through a pump and pipeline system using an assembly of components according to claim 1, comprising:

comminuting as-mined oil sand to conveyable size;

delivering the comminuted oil sand to a surge bin;

removing oil sand from the surge bin and delivering it to an elevated discharge point;

preparing a pumpable oil sand sluffy using the oil sand by:

feeding the oil sand into and comminuting it in a plurality of downwardly descending secondary comminution stages to sequentially reduce its particle size to pumpable size, adding heated water to the oil sand in the course of secondary comminution and mixing them to form the pumpable sluffy; and discharging the slurry into a pump box for feeding to the pump and pipeline system.

* * * * *

UNITED STATES PATENT AND TRADEMARK OFFICE

CERTIFICATE OF CORRECTION

PATENT NO. : 7,431,830 B2
APPLICATION NO. : 10/932019
DATED : October 7, 2008
INVENTOR(S) : Ron Cleminson et al.

It is certified that error appears in the above-identified patent and that said Letters Patent is hereby corrected as shown below:

Column 5, line 13, claim 1 change “sluffy” to -- slurry --.

Column 5, line 15, claim 1 change “sluffy” to -- slurry --.

Column 6, line 23, claim 10 change “sluffy” to -- slurry --.

Column 6, line 30, claim 10 change “sluffy” to -- slurry --.

Signed and Sealed this

Tenth Day of March, 2009

JOHN DOLL
*Acting Director of the United States Patent and Trademark Office*